US007215303B2

(12) United States Patent
Ando et al.

(10) Patent No.: US 7,215,303 B2
(45) Date of Patent: May 8, 2007

(54) AC-TYPE PLASMA DISPLAY PANEL CAPABLE OF HIGH DEFINITION AND HIGH BRIGHTNESS IMAGE DISPLAY, AND A METHOD OF DRIVING THE SAME

(75) Inventors: Toru Ando, Osaka (JP); Hiroyuki Tachibana, Toyonaka (JP); Naoki Kosugi, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 323 days.

(21) Appl. No.: 10/149,300

(22) PCT Filed: Dec. 11, 2000

(86) PCT No.: PCT/JP00/08764

§ 371 (c)(1),
(2), (4) Date: Feb. 27, 2003

(87) PCT Pub. No.: WO01/45132

PCT Pub. Date: Jun. 21, 2001

(65) Prior Publication Data

US 2003/0112206 A1 Jun. 19, 2003

(30) Foreign Application Priority Data

Dec. 14, 1999 (JP) ..... 11-354298

(51) Int. Cl.
*G09G 3/28* (2006.01)

(52) U.S. Cl. ..... 345/60; 345/62

(58) Field of Classification Search ..... 345/60–72; 313/483–497

See application file for complete search history.

(56) References Cited

U.S. PATENT DOCUMENTS

| | | | | |
|---|---|---|---|---|
| 5,770,921 | A | 6/1998 | Aoki et al. | |
| 5,993,543 | A * | 11/1999 | Aoki et al. | 117/88 |
| 6,097,150 | A | 8/2000 | Watanabe | |
| 6,177,762 | B1 | 1/2001 | Nakayama | |
| 6,184,848 | B1 * | 2/2001 | Weber | 345/60 |
| 6,611,099 | B1 * | 8/2003 | Murata et al. | 313/582 |

FOREIGN PATENT DOCUMENTS

| | | |
|---|---|---|
| CN | 1190232 A | 8/1998 |
| JP | 4274140 A | 9/1992 |

(Continued)

*Primary Examiner*—Sumati Lefkowitz
*Assistant Examiner*—Tammy Pham

(57) ABSTRACT

Plasma display panel (PDP), PDP display apparatus, and method for driving the PDP. The PDP is a surface discharge AC PDP having a first substrate and a second substrate arranged to face each other with barrier ribs interposed therebetween. A first electrode and a second electrode are arranged on a facing surface of the first substrate so as to extend parallel to each other, and are covered with a dielectric layer. A third electrode is arranged on a facing surface of the second substrate so as to extend orthogonally to the first and second electrodes. A discharge gas is enclosed within a discharge space defined between the interposed barrier ribs. In the above PDP, the discharge gas is a gas mixture containing xenon. The xenon component comprises at least 5 vol % and less than 100 vol %, and has a partial pressure of at least 2 kPa. Furthermore, the gap between the first and second electrodes in the PDP is greater than a height of the discharge space.

35 Claims, 11 Drawing Sheets

FOREIGN PATENT DOCUMENTS

| | | |
|---|---|---|
| JP | 10-334811 | 12/1998 |
| JP | 11-143425 | 5/1999 |
| JP | 2000-097339 | 3/2000 |
| JP | 2000-260333 | 9/2000 |
| JP | 2000-294151 | 10/2000 |
| KR | 99078437 A | 10/1999 |

* cited by examiner

AC-TYPE PLASMA DISPLAY PANEL CAPABLE OF HIGH DEFINITION AND HIGH BRIGHTNESS IMAGE DISPLAY, AND A METHOD OF DRIVING THE SAME

TECHNICAL FIELD

The invention relates to an alternating current (AC) plasma display panel (PDP) used in computers, televisions, and the like, and a related method for driving the PDP.

BACKGROUND ART

Research into displays in recent years has been stimulated by the demand for improved performance, particularly in relation to higher definition (high vision, etc) and flatter devices.

Leading the way in flat panel technology are liquid crystal displays (LCDs) and plasma display panels (PDPs). PDPs are particularly suitable for thin, large-screen applications, and 50-inch class models are already being developed.

Direct current (DC-type) and alternating current (AC-type) are the two broad categories of PDP, although AC PDPs are currently preferred for their particular suitability in large-screen applications.

FIG. 11A shows a sectional view of a main part of an exemplary prior art surface discharge AC PDP. FIG. 11B shows a sectional view along the A—A axis of the prior art PDP.

A PDP is commonly composed of a matrix of colored luminous cells. A known surface discharge AC PDP, as disclosed, for example, in unexamined patent application publication 9-35628 published in Japan, has the structure shown in FIGS. 11A and 11B. In this PDP, a front glass substrate 211 and a back glass substrate 221 are arranged parallel to and facing each other with barrier ribs 224 interposed therebetween. A parallel pair of discharge electrodes (scan electrode 212*a* and sustain electrode 212*b*) are arranged on the facing surface of front glass substrate 211, and covered with a dielectric layer 213 and a protective layer 214. An address electrode 222 is arranged on the facing surface of the back glass substrate 221 so as to extend in an orthogonal direction to electrodes 212*a* and 212*b*. Colored luminous cells are formed by arranging a colored phosphor layer 225 within a space 230 defined between the interposed barrier ribs. Space 230 is filled with a discharge gas containing neon and xenon, for example.

In this PDP, a drive circuit applies a voltage to each of the electrodes. Since each cell can only express the states of "on" or "off", however, one field is divided into a plurality of subfields, and then by controlling the on/off timing of each subfield and thereby varying the combination of "on" subfields, intermediate graduations may be expressed with respect to the colors red (R), green (G) and blue (B).

Image display in a PDP is generally achieved in each of the subfields by using the so-called address display period separated subfield (ADS) method. This method involves a setup period, an address period, and a sustain period that are conducted consecutively. In the setup period a pulse voltage is applied uniformly to all the scan electrodes. In the address period a pulse voltage is applied sequentially to the scan electrodes as well as to address electrodes selected from among the plurality of address electrodes, and as a result wall charge is stored in the cells to be turned on. Finally, a pulse voltage is applied between the scan and sustain electrodes in the sustain period in order to sustain the discharge. Ultraviolet (UV) light is generated as a result of the sustain discharge, and image display is achieved when the phosphor elements (red, green, blue) are excited to illumination through contact with the UV light.

An object of the prior art PDP is to enhance luminous efficiency while maintaining a low drive voltage, this being a long-held objective of PDP designers. Keeping the drive voltage at a low level helps to simplify the circuitry architecture and minimize any losses relating to inefficient power usage.

In view of these factors, the pressure of the gas enclosed within the PDP is generally maintained at approximately 40 kPa to 65 kPa, and the xenon (Xe) component of the gas is maintained at around 5 vol %. Furthermore, the size of a gap dp (surface discharge gap) between the scan electrode 212*a* and the sustain electrode 212*b* in each pair is established at a value close to the minimum discharge voltage shown on a Paschen curve (generally about 80 μm), thus maintaining an external sustain voltage Vsus in a range from 180V to 200V.

As shown in FIGS. 11A and 11B, the discharge electrodes 212*a* and 212*b* are composed of transparent electrodes 2121*a* and 2121*b* and metal bus lines 2122*a* and 2122*b*, which allows for the discharge to expand by way of the transparent electrodes.

While conventional technology has been effective in enhancing the luminous efficiency of PDPs, currently achievable efficiency levels of approximately 11 m/W are still only about one-fifth of that achievable by cathode ray tube (CRT) displays.

Increasing the xenon partial pressure of the enclosed discharge gas has also proved effective in enhancing luminous efficiency. U.S. Pat. No. 5,770,921, for example, achieves this result by establishing the xenon component at 10 vol % or greater. Still further improvements are desired, however.

DISCLOSURE OF INVENTION

An object of the invention is to provide a PDP, a PDP display apparatus, and a related drive method capable of greatly enhancing luminous efficiency in comparison with conventional levels, while at the same time maintaining a low discharge sustain voltage.

A PDP capable of achieving this object has a first substrate and a second substrate arranged to face each other with barrier ribs interposed therebetween. A first electrode and a second electrode are arranged on a facing surface of the first substrate, the first and second electrodes extending parallel to each other and being covered with a dielectric layer. A third electrode is arranged on a facing surface of the second substrate so as to extend orthogonally to the first and second electrodes. A discharge gas is enclosed within a discharge space defined between the interposed barrier ribs. In this PDP, the discharge gas is a gas mixture containing xenon, the xenon component comprising at least 5 vol % and less than 100 vol % and having a partial pressure of at least 2 kPa. Furthermore, in this PDP, the gap between the first and second electrodes is greater than a height of the discharge space. The height of the discharge space is here measured in a thickness direction of the PDP, and approximates the distance separating the third electrode from either the first or second electrodes.

According to this configuration, it is possible to achieve a high luminous efficiency when the PDP is driven. This is due to the high Xe partial pressure and consequent high levels of xenon present in the discharge space.

The above result is achieved as follows and is disclosed in U.S. Pat. No. 5,770,921 mentioned above. High levels of Xe in the discharge space help to generate more UV light, leading to an increased peak of an excitation wavelength (173 nm) formed by radiation from Xe molecules. The conversion efficiency of the phosphors emitting visible light is improved as a result.

Also, the fact that the gap between the first and second electrodes is greater than the height of the discharge space means that when a sustain pulse of alternating polarity is applied between the first and second electrodes, the discharge path is lengthened to form a positive column discharge. A positive column discharge is known to achieve a high luminous efficiency and is, therefore, desirable.

Also, the fact that a discharge is initiated between the third electrode and either the first or second electrodes when a sustain pulse is applied in the sustain discharge (the gap separating the third electrode from either the first or second electrodes being shorter than the gap between the first and second electrodes) allows the voltage applied in initiating the discharge to be maintained at a low level.

In other words, when a sustain pulse, during which the second electrode is negative, is applied in order to sustain the discharge, a discharge is initiated between the second and third electrodes, even at a low applied voltage, and the initiated discharge expands in the direction of the first electrode. Likewise, when a sustain pulse, during which the first electrode is negative, is applied in order to sustain the discharge, a discharge is initiated between the first and third electrodes, even at a low applied voltage, and the initiated discharge expands in the direction of the second electrode. Thus it is possible to sustain the discharge at a relatively low voltage, despite the large gap separating the first and second electrodes.

As described above, the present invention is able to greatly enhance luminous efficiency in comparison with known PDPs, while at the same time maintaining the discharge voltage at a low level.

Increasing the gap between the first and second electrodes, therefore, leads to improved luminous efficiency, although cell pitch and drive voltage place limitations on the practical size of this gap. Despite these limitations, however, a gap several times the height of the discharge space can still be achieved.

BEST MODE FOR CARRYING OUT THE INVENTION

PDP Structure and the Related Drive Method

Figure 1:
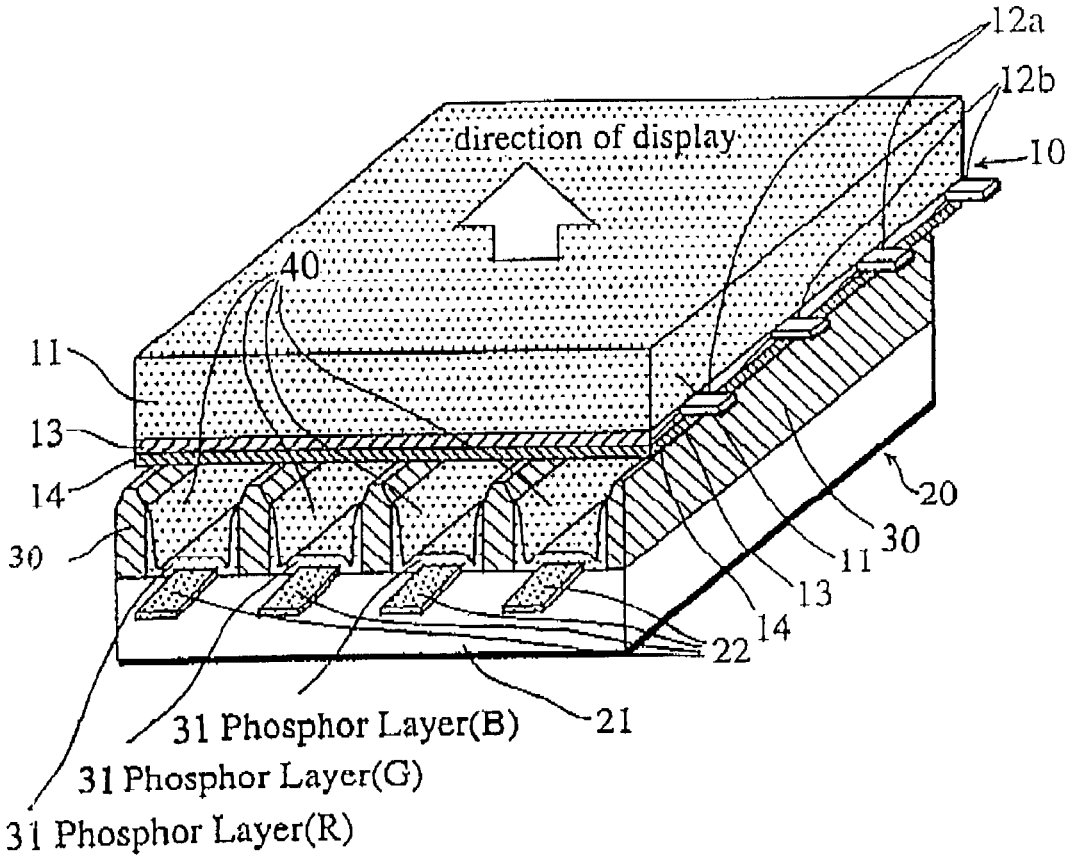
FIG. 1 is a perspective overview showing a structure of a surface discharge AC PDP according to an embodiment of the present invention.

FIG. 1 is a perspective overview showing a structure of a surface discharge AC PDP according to the present embodiment.

The PDP of the present invention is formed from a front panel 10 and a back panel 20 that are positioned parallel to and facing each other with a space defined therebetween. Front panel 10 includes a front glass substrate 11, and back panel 20 includes a back glass substrate 21. The facing surface of front glass substrate 11 has arranged thereon first electrodes (scan electrodes) 12*a*, second electrodes (sustain electrodes) 12*b*, a dielectric layer 13, and a protective layer 14. A facing surface of back glass substrate 21 has arranged thereon third electrodes (address electrodes) 22.

The space between the front and back panels is partitioned by barrier ribs 24 formed in a stripe pattern, and the interposed barrier ribs define discharge spaces 30. A discharge gas is enclosed within discharge spaces 30.

Phosphor layers 25 are formed between adjacent barrier ribs 24 on back panel 20. The phosphor layers correspond respectively to the colors red, green, and blue, and are arranged repeatedly in the stated order so as to face into discharge spaces 30.

The electrodes 12*a*, 12*b*, and 22 are metal electrodes formed in a stripe pattern, and may be constructed, for example, by applying an Ag paste in a stripe pattern and firing the paste. The first and second electrodes extend in a direction orthogonal to barrier ribs 24, while third electrode 22 extends in a direction parallel to the barrier ribs.

The gap between the first and second electrodes (surface discharge gap) is greater than a height of discharge spaces 30 (i.e. in a thickness direction of the PDP, hereafter "vertical discharge gap"). This configuration will be described below in greater detail.

Dielectric layer 13 is composed of a dielectric material and is arranged to cover the entire surface of front glass substrate 11 on which electrodes 12*a* and 12*b* are arranged. Dielectric layer 13 is generally formed, for example, from a low melting lead glass or bismuth glass.

Protective layer 14 is a thin layer formed from magnesium oxide (MgO) and other materials having a high secondary electron emission coefficient, and covers the entire surface of dielectric layer 13.

Barrier ribs 24 are composed of a glass material and are mounted onto the facing surface of back glass substrate 21.

Although the above description relates to a dielectric layer being formed only on front glass substrate 11, a dielectric layer may also be formed over third electrodes 22 on back glass substrate 21, and phosphor layers 25 may then be formed over this dielectric layer.

The discharge gas is a gas mixture composed of xenon (Xe) and at least one of helium (He), neon (Ne), and argon (Ar), all of which are known in prior art PDPs. The xenon partial pressure is established at 2 kPa or greater to ensure a high level of xenon in the discharge space. Thus when the total pressure of the discharge gas is in a range from 40 kPa to 67 kPa inclusive, the xenon component of the gas mixture is 5 vol % or greater.

In order to achieve a high luminous efficiency, the xenon partial pressure should preferably be established at 6.7 kPa or greater, or even 10 kPa or greater. A xenon partial pressure of 16 kPa is considered the upper limit given the capacity of known drive circuits. This area will be covered in greater detail below.

Figure 2:
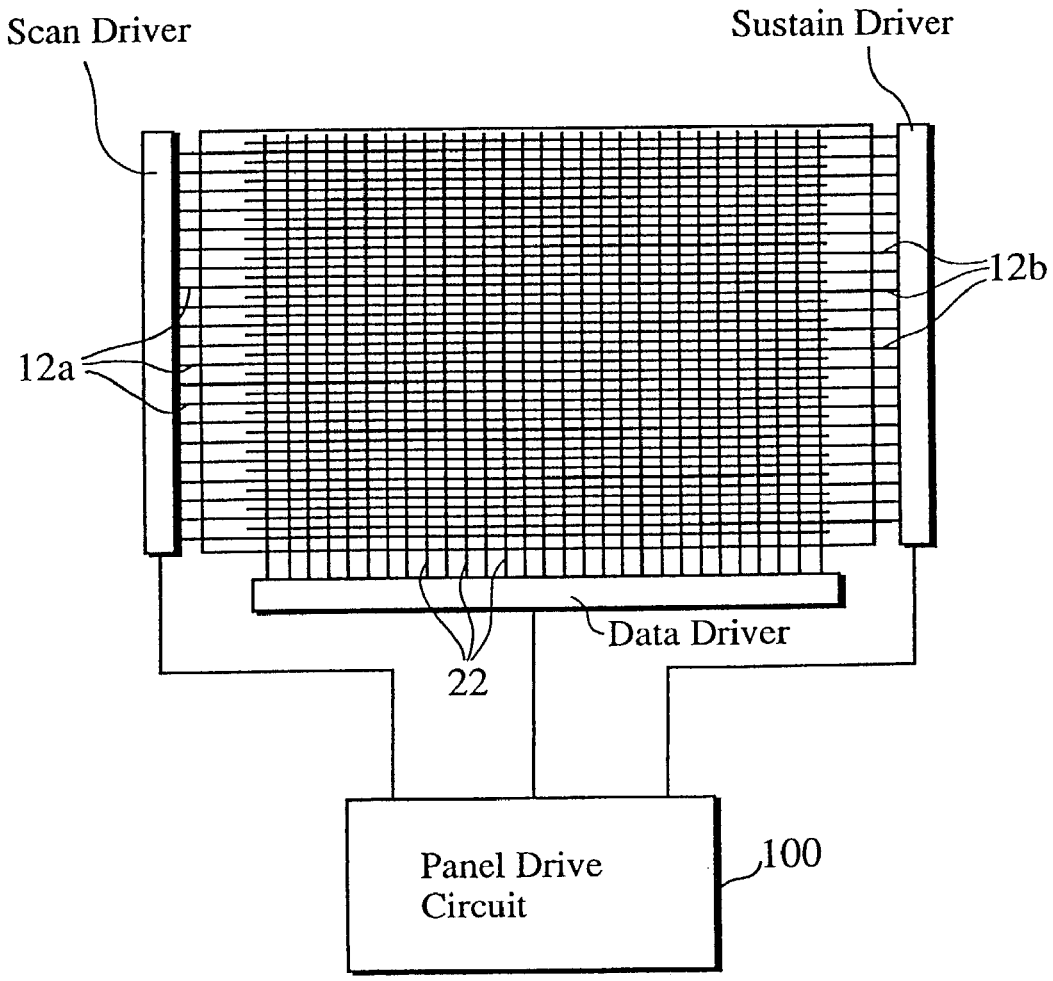
FIG. 2 shows a structure of a display apparatus connected to a drive circuit 100 of the PDP.

FIG. 2 shows a structure of a display apparatus connected to drive circuit 100 of the PDP. As shown in FIG. 2, third electrodes 22 extend in an orthogonal direction to electrodes 12*a* and 12*b*. Discharge cells are formed in the space between the front and back glass substrates, and one pixel is composed of three cells (red, green, blue) adjacent in a lengthwise direction of electrodes 12*a* and 12*b*.

According to this structure, an expansion of the discharge from one cell into an adjacent cell can be prevented as a result of neighboring discharge cells being partitioned off by barrier ribs 24.

Figure 3:
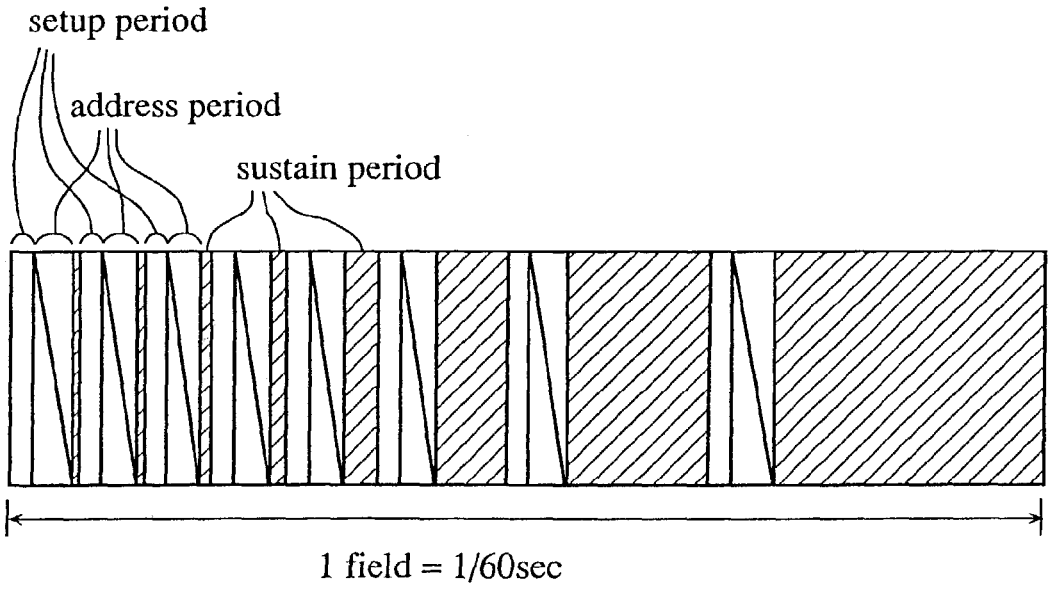
FIG. 3 shows an exemplary method for-dividing a field when the display apparatus is driven.

FIG. 3 shows an exemplary method for dividing a field in order to express 256 brightness values, the horizontal axis marking time and the shaded areas representing the sustain periods.

According to this exemplary division method, one field is composed of eight subfields, the sustain period ratio of the eight subfields being 1, 2, 4, 8, 16, 32, 64, and 128, and the 256 brightness values being expressed through a combination of these eight bit binary values. Given that an image is composed of 60 fields per second according to the NTSC standard, the period of one field is established at 16.7 ms.

Each subfield is composed of consecutive setup, address, and sustain periods, and one field of image display is achieved by conducting eight times the operation (i.e. setup, address, and sustain periods) of a single subfield.

FIGS. 4A to 4D show a timing, within a single subfield, of the pulses applied by drive circuit 100 to each of the electrodes.

Figures 4A, 4B, 4C, 4D:
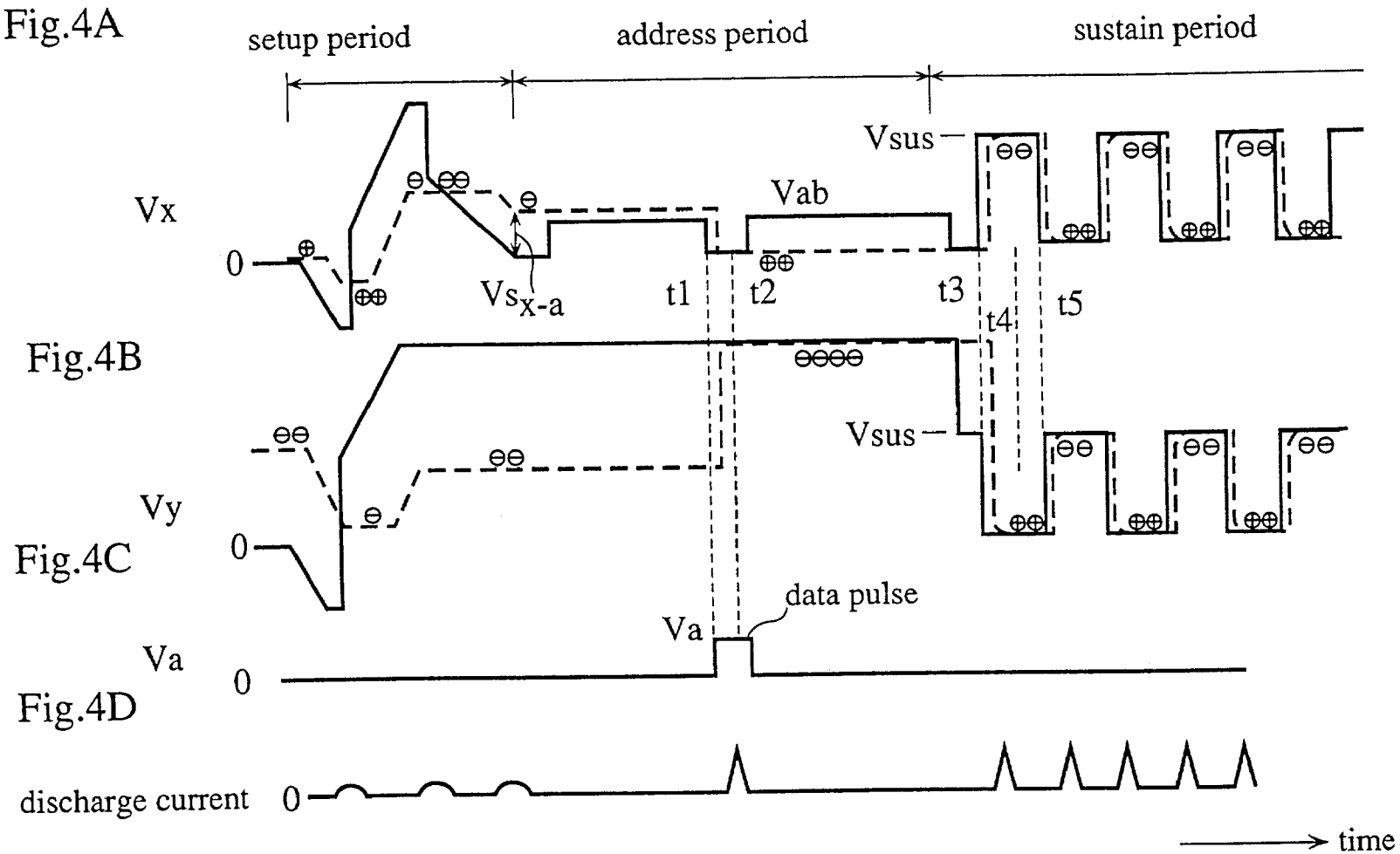
FIGS. 4A~4D show a timing, within a single subfield, of pulses applied by the drive circuit to each of the electrodes.

FIG. 4A shows a voltage waveform Vx applied to a first electrode 12*a*, FIG. 4B shows a voltage waveform Vy applied to a second electrode 12*b*, FIG. 4C shows a voltage waveform Va applied to a third electrode 22, and FIG. 4D shows a waveform of an absolute value of the current resulting from the discharge.

It should be noted that although a pulse is applied sequentially to a plurality of first electrodes as well as to a plurality of selected third electrodes in the address period, for ease of understanding, FIGS. 4A to 4D refer only to a single first electrode 12*a*, a single second electrode 12*b*, and a single third electrode 22.

In the setup period, a positive initializing pulse is applied simultaneously to all first electrodes 12*a*, thus storing wall charge on both protective layer 14 and phosphor layers 25, and initializing all the discharge cells.

In the address period, a positive data pulse is applied to selected third electrodes 22, and a negative scan pulse is applied sequentially to first electrodes 12*a*. As a result, a discharge is initiated between the first and third electrodes in the cells to be turned on (hereafter, the "on" cells), wall charge forms on the surface of protective layer 14, and one full screen of pixel information is written in a subfield.

In the sustain period, an AC voltage is applied collectively between the first and second electrodes, which results in a selective plasma discharge occurring only in the cells storing wall charge.

Surface Discharge Gap and Vertical Discharge Gap

Figure 5:
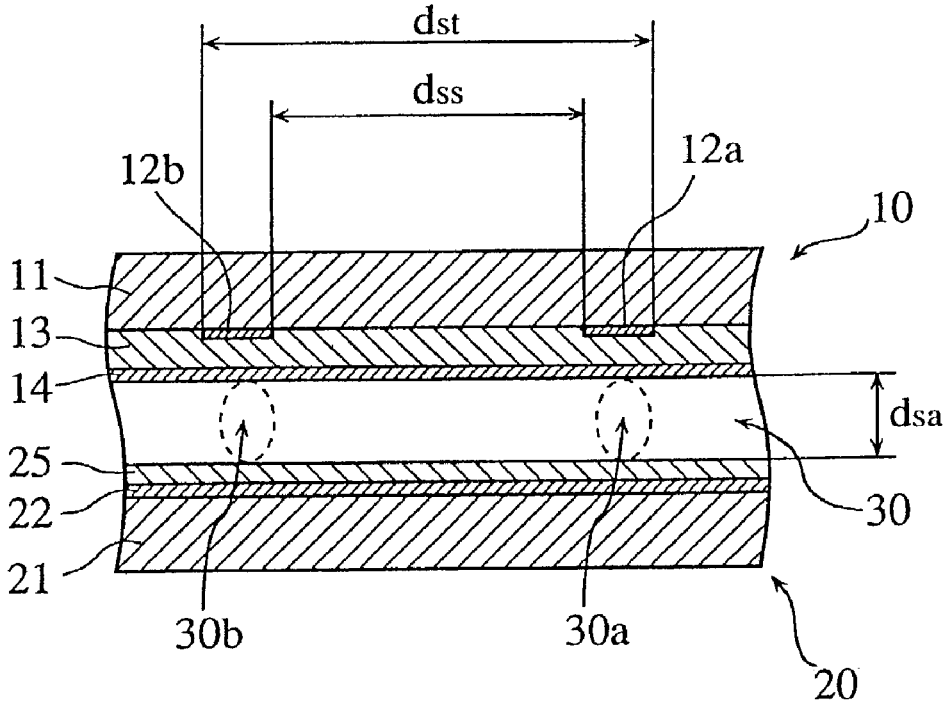
FIG. 5 shows a cross-section of the PDP in a length direction of an address electrode.

FIG. 5 shows a cross-section of the PDP in a lengthwise direction of third electrodes 22.

As shown in FIG. 5, the surface discharge gap dss between the first and second electrodes is greater than the vertical discharge gap dsa between the facing surfaces of protective layer 14 and phosphor layers 25 (i.e. dss>dsa).

In designing a surface discharge AC PDP, the size of the vertical discharge gap dsa should ideally be established so as to facilitate the address discharge. In practice, however, the size of the gap is determined by factors such as the pressure of the discharge gas and the volume of the discharge space required to maintain a stable discharge.

In known PDPs, the surface discharge gap dss, on the other hand, is commonly established in accordance with Paschen's Law, which results in the gap dss being smaller than the gap dsa.

Thus, when the surface discharge gap dss is established to be larger than the vertical discharge gap dsa, as in the present embodiment, the length of the discharge in the sustain period is increased in comparison with prior art PDPs.

Although the practical size of the surface discharge gap dss is limited by cell pitch, a gap several times that of the vertical discharge gap dsa can still be achieved.

Specifically, the distance dst between the outer edge of the first and second electrodes (see FIG. 5) is limited by cell pitch, which in turn effectively limits the size of the surface discharge gap dss. However, the size of the gap dss can be maximized within these limits by using only metal electrodes without providing transparent electrodes, and narrowing the width of the first and second electrodes as much as possible. A surface discharge gap dss several times that of the vertical discharge gap dsa can thus be achieved.

The gap dss is also restricted by the drive voltage, since even slight increases in the surface discharge gap dss lead to increases in the drive voltage. Despite this, the PDP of the present embodiment can still be driven with a gap dss five to six times that of the vertical discharge gap dsa.

Since the surface discharge gap dss should preferably be made as large as possible in order to achieve a longer discharge, it is advantageous for the gap dss to be at least 1.2 times, if not 1.5 times or even two or three times, the size of the vertical discharge gap dsa.

Chart 1 shows exemplary design parameters of the PDP according to the present embodiment.

CHART 1

| | |
|---|---|
| Single Pixel Size | 1080 × 1080 $\mu m^2$ |
| Surface Discharge Cap (dss) | 400 μm |
| Vertical Discharge Cap (dsa) | 90 μm |
| Barrier Rib Height | 120 μm |
| First/Second Electrode Width | 100 μm |
| Gas Composition | Ne (80%), Xe (20%) |
| Gas Pressure | 80 kPa |

Figure 11A:
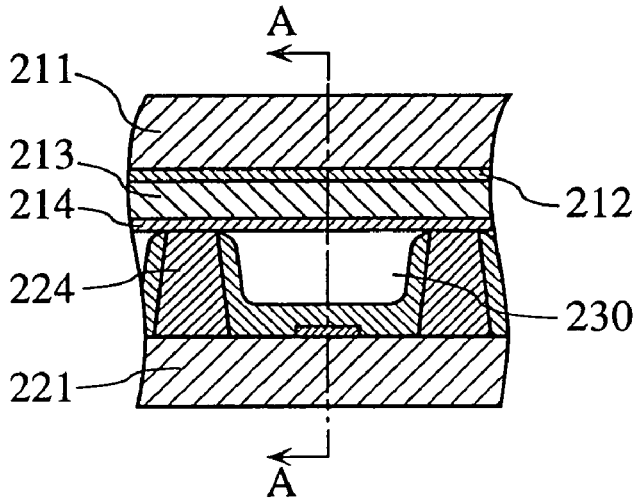
Fig.11A Prior Art
FIGS. 11A~11B are cross-sectional views of a main section of the prior art PDP.
Figure 11B:
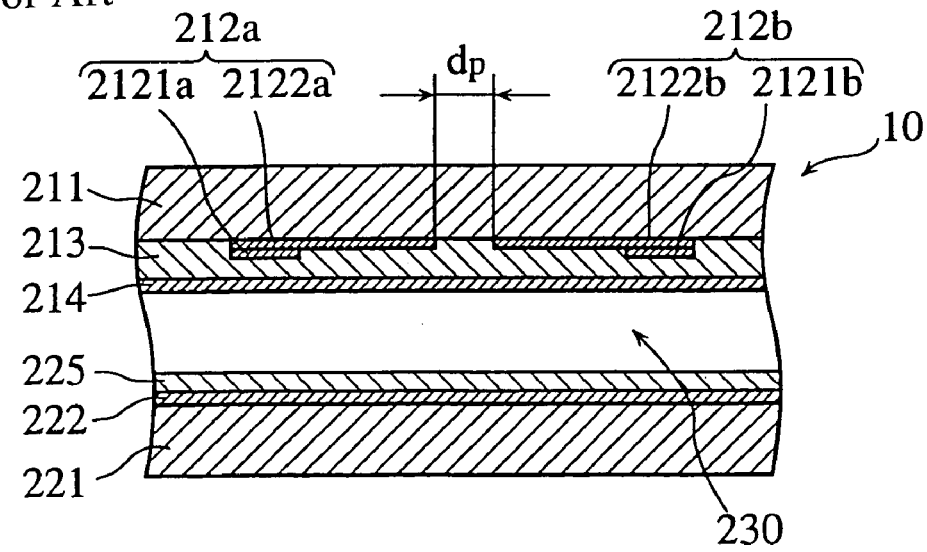
Fig.11B Prior Art

According to the above design parameters, the surface discharge gap dss between the first and second electrodes is 400 μm, which is more than four times the vertical discharge gap dsa (90 μm), and five times the surface discharge gap dss (80 μm) of the prior art PDP shown in FIGS. 11A and 11B.

Applied Pulses and Resultant Discharge Patterns in Each Period

The following refers to FIGS. 4A to 4D in describing both the pulses applied in each of the setup, address, and sustain periods, and the patterns of discharge resulting from the pulses. Although the waveform of the pulses applied by drive circuit 100 are basically the same as in prior art PDPs, novelty lies in the discharge patterns arising from these pulses.

In FIG. 4A, the broken line represents the wall voltage generated on phosphor layers 25 over third electrodes 22, and on dielectric layer 13 and protective layer 14 over first electrodes 12*a*. The broken line in FIG. 4B represents the wall voltage generated on phosphor layers 25 over third electrodes 22, and on dielectric layer 13 and protective layer 14 over second electrodes 12*b*. The polarity of stored wall charge is shown above the respective broken lines.

The wall voltage is generated by wall charge stored on protective layer 14 and phosphor layers 25 subsequent to the ignition of the discharge.

Also, the difference between the applied voltage (solid lines) and the wall voltage (broken lines) is equivalent to the voltage applied within the discharge space between the address electrode and each first and second electrode.

FIGS. 6A to 6C and FIGS. 7A to 7C show the discharge patterns of the PDP, and will be referred to during the following description.

Setup Period:

In the first half of the setup period, a decreasing ramp voltage based on the potential of third electrodes 22 is applied to both the first and second electrodes. Protective layer 14, which has a comparatively high secondary electron emission coefficient, thus becomes the cathode, and a weak discharge is readily initiated within a first vertical discharge space 30*a* (i.e. the discharge space between the first and third electrodes) and a second vertical discharge space 30*b* (i.e. the discharge space between the second and third electrodes). Initializing charge is formed within the first and second vertical discharge spaces as a result of this discharge.

In a middle period of the setup period, an increasing ramp voltage based on the potential of third electrodes 22 and having a relatively large amplitude is applied to both the first and second electrodes. A discharge occurs in the first and second vertical discharge spaces as a result, which in turn leads to negative charge being stored on protective layer 14 over the first and second electrodes.

In the latter half of the setup period, a decreasing ramp voltage based on the potential of third electrodes 22 is applied to first electrodes 12*a*. A discharge occurs in the first vertical discharge spaces 30*a* as a result, which in turn leads to the elimination of some of the negative wall charge stored on the surface of protective layer 14.

For the duration of the ramp voltage there is a continuous flow of current resulting from the discharge, and in the first vertical discharge spaces 30*a* a voltage approximating the magnitude of the discharge sustain voltage Vs is constantly applied. Consequently, when the setup period is completed, the difference between the applied voltage and the wall voltage is approximately equal to the discharge sustain voltage Vs within the discharge spaces. In FIGS. 4A to 4D, the voltage applied in the first vertical discharge spaces 30*a* at the completion of the setup period is $Vs_{x-a}$.

The setup pulse waveform is substantially the same as that disclosed in unexamined patent application publication 12-267625 published in Japan. By utilizing such a waveform, the initialization can be conducted in a comparatively short period of time, which thus allows for the sustain period to be extended.

Address Period:

In the address period, a bias voltage Vab and a negative pulse voltage are applied to first electrodes 12*a*, the pulse voltage being applied while sequentially scanning first electrodes 12*a*. At the same time, a discharge is selectively initiated in the "on" cells by applying a positive data pulse (voltage Va) to third electrodes 22 corresponding to the "on" cells.

Also in the address period, a positive voltage based on the potential of first electrodes 12*a* is applied continuously to second electrodes 12*b*.

As a result, a voltage ($VS_{x-a}$+Va) is applied in the first vertical discharge space 30*a* of the "on" cells at time t1, initiating a discharge in these discharge spaces.

The voltage ($Vs_{x-a}$) is substantially the same as the discharge sustain voltage applied in the first vertical discharge spaces 30*a*, thus allowing the discharge to be initiated at a comparatively low data pulse voltage Va.

Also, because of the positive voltage, which is based on the potential of first electrodes 12*a*, being continuously applied to second electrodes 12*b* as described above, the discharge generated in the first vertical discharge space 30*a* of the "on" cells expands towards second electrodes 12*b*, initiating a discharge in the second vertical discharge space 30*b* of the "on" cells.

Figure 6A:
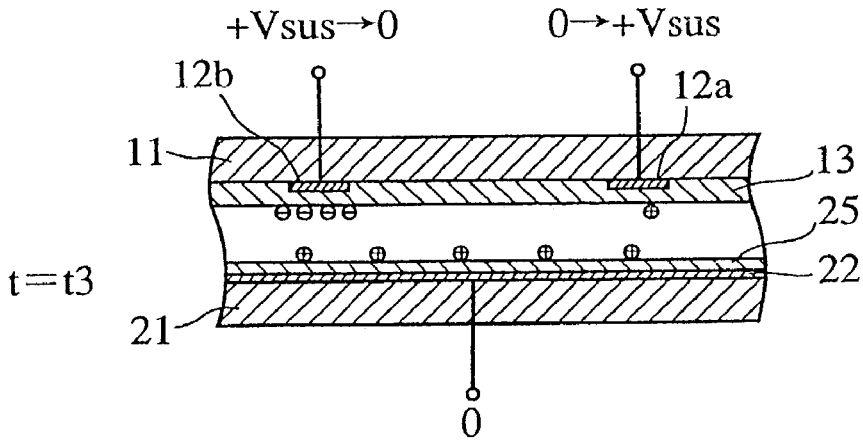
FIGS. 6A~6C and FIGS. 7A~7C show discharge patterns of the PDP.

As a result, in the "on" cells positive charge is stored on protective layer 14 over first electrode 12*a*, and negative charge is stored on protective layer 14 over second electrode 12*b*, as shown in FIG. 6A.

In contrast, no data pulse is applied to third electrodes 22 corresponding to the "off" cells, and as a result no discharge occurs in these cells. Thus at the completion of the setup period, the charge stored on protective layer 14 over the first and second electrodes in the "off" cells remains substantially unchanged.

Sustain Period:

In the sustain period, first and second sustain pulses having opposite polarities and an amplitude Vsus, are applied alternately between the first and second electrodes.

FIGS. 6A to 6C and FIGS. 7A to 7C are simplified cross-sectional views of the PDP of the present embodiment showing the state of the applied voltage, the wall charge, and the discharge plasma when the first sustain pulse is applied (note: protective layer 14 is not depicted in these drawings).

The following describes in detail, with reference to FIGS. 6A to 6C and FIGS. 7A to 7C, the way in which a discharge initiated in the second vertical discharge space 30*b* of an "on" cell expands in the sustain period to the first vertical discharge space 30*a* of the "on" cell.

As shown in FIGS. 4A to 4D, an external sustain voltage Vsus is applied to first electrode 12*a* at time t3 and second electrode 12*b* is grounded.

Consequently, the polarity of the first sustain pulse applied at time t3 is such that second electrode 12*b* is negative and first electrode 12*a* is positive.

The negative polarity of second electrode 12*b* results from the negative wall charge stored on dielectric layer 13 over second electrode 12*b* in the "on" cells in the address period. Thus the discharge initiated by applying the first sustain pulse is such that second electrode 12*b* (i.e. on the side of the second vertical discharge space 30*b*) is negative.

The discharge generated in the second vertical discharge space 30*b* expands toward first electrode 12*a* as a result of positive wall charge stored on the surface of phosphor layer 25. By way of note, the storage of positive wall charge on the phosphor layer results from third electrode 22 having a low potential relative to the high positive voltage applied to second electrode 12*b* in the address period, which leads to the third electrode attracting positive charge.

Figure 6B:
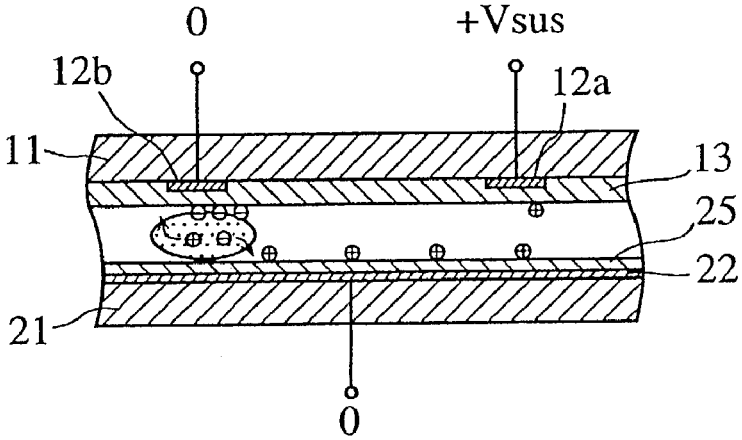

FIG. 6B shows the initiation of a discharge in the second vertical discharge space 30*b*. Large amounts of positive and negative charge generate from this discharge, and the generated charge is attracted to the second and third electrodes, respectively, thereby forming wall charge. The wall voltage generated by the wall charge serves to eliminate the voltage applied in the second vertical discharge space 30*b* and terminate the discharge within this discharge space.

Because the dielectric constant of phosphor layer 25 over third electrode 22 is smaller than that of dielectric layer 13 over second electrode 12*b*, wall charge is stored at a faster rate on phosphor layer 25.

As a result, the part of the discharge nearest the anode (i.e. nearest first electrode 12*a* during the first sustain pulse) is attracted to and moves along the surface of phosphor layer 25, depositing negative charge as it proceeds (see FIG. 6B/C).

Figure 6C:
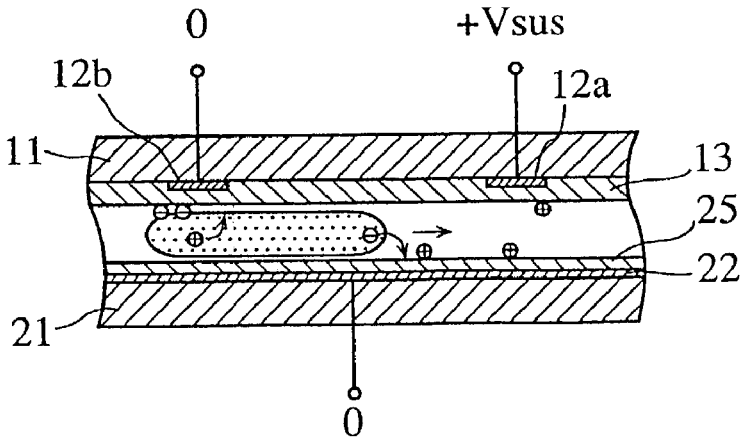

In contrast, the positive voltage, which is based on the potential of second electrode 12*b*, applied to first electrode 12*a* helps guide the expanding discharge toward first electrode 12*a*. FIG. 6C shows the part of the discharge nearest the anode expanding toward first electrode 12*a*, eliminating the positive charge stored on the surface of phosphor layer 25 as it proceeds.

Figure 7A:
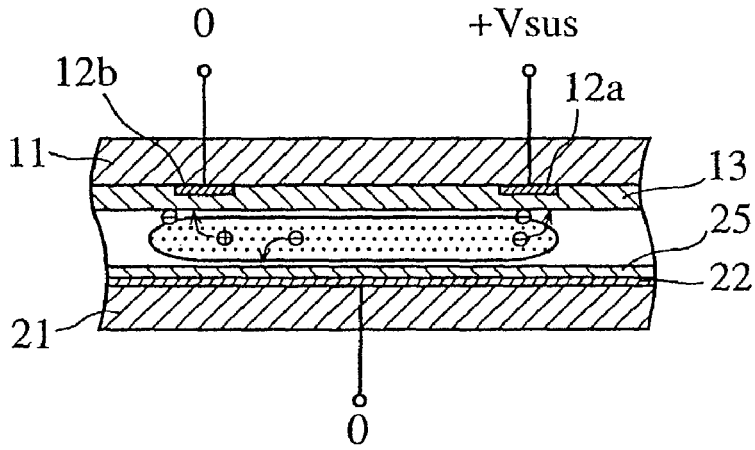

As shown in FIG. 7A, the anode side of the discharge reaches first electrode 12*a* at time t4, thus generating a discharge in the first vertical discharge space 30*a*.

Figure 7B:
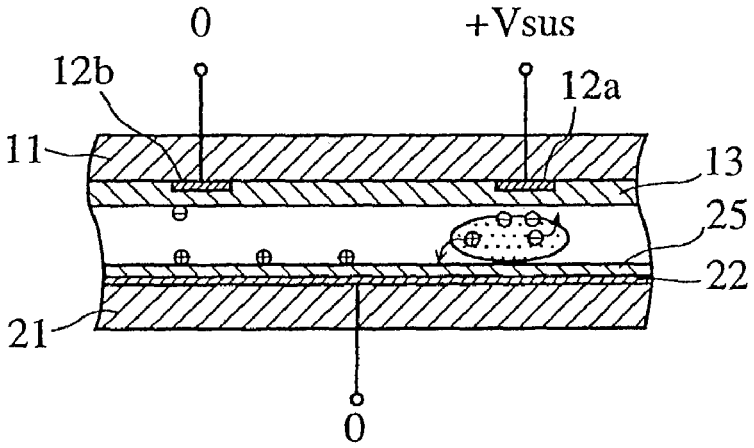
Figure 7C:
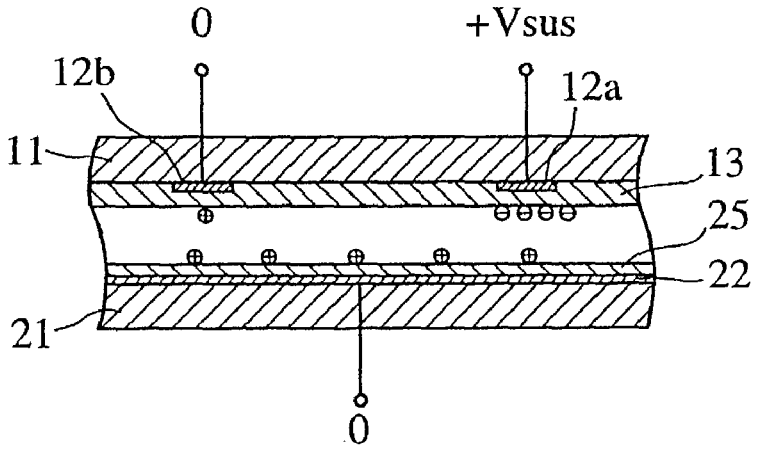

FIG. 7B shows the discharge immediately before termination, and FIG. 7C shows the discharge having been terminated as a result of wall charge stored on dielectric layer 13 and phosphor layer 25.

Subsequent to the discharge described above, negative and positive wall charge forms on the surface of dielectric layer 13 and phosphor layer 25, respectively, in the first vertical discharge space 30*a*. As a result, negative charge is stored on dielectric layer 13 over first electrode 12*a*, and positive charge is stored on phosphor layer 25 and on dielectric layer 13 over second electrode 12*b*.

As shown in FIG. 7C, almost all of the wall charge has been eliminated from the second vertical discharge space 30*b* within which the discharge originated.

Large amounts of UV light emits from the positive column discharge as a result of the long discharge connecting the first and second vertical discharge spaces. Here, "positive column discharge" is used to refer to any filament-shaped discharge generated in a long discharge space between electrodes.

The distribution of wall charge in FIG. 7C is the opposite of that at time t3 (see FIG. 6A). In FIGS. 4A to 4D, the second sustain pulse at time t5 is applied in the same manner as the first sustain pulse at time t3, although the function of the first and second electrodes is reversed. Thus an external sustain discharge Vsus is applied to second electrodes 12*b* and first electrodes 12*a* are grounded.

Repetitions of an identical sustain discharge can be achieved as a result.

The surface discharge patterns occurring in the sustain period according to the present embodiment differ to those of the prior art PDP shown in FIGS. 11A and 11B. Specifically, the discharge according to the present embodiment is generated via the vertical discharge gap, and is, therefore, somewhat similar to a discharge formed between electrodes positioned facing one another (i.e. as opposed to electrodes positioned on a flat plane).

Furthermore, the timing at time t3 of (i) the application of the external sustain voltage Vsus to first electrodes 12*a* and (ii) the grounding of second electrodes 12*b* should preferably be such that second electrodes 12*b* (i.e. on the side of the second vertical discharge space 30*b*) are negative when the discharge is initiated. This timing can be realized as follows.

One method is to firstly apply the external sustain voltage Vsus to first electrodes 12*a* (i.e. no discharge generated), and then to initiate a discharge by grounding second electrodes 12*b*. A further method involves grounding second electrodes 12*b* and then applying the external sustain voltage Vsus to first electrodes 12*a* for the desired duration of the discharge. The latter method allows for a reduction in the discharge current, which serves to reduce the load on the drive circuit.

Effects of the PDP of the Present Embodiment

As described above, by establishing the xenon partial pressure in the PDP of the present embodiment at 2 kPa or greater, the level of xenon in discharge spaces 30 is increased (note: at total discharge gas pressures of 40 kPa or greater, the xenon component of the discharge gas is 5 vol % or greater). Moreover, by establishing the surface discharge gap dss to be greater than the height of discharge spaces 30, a longer discharge can be sustained at a low discharge voltage, which allows for luminous efficiency to be enhanced while maintaining a low discharge voltage. The reasons and supporting material for these effects are detailed below.

Firstly, the reasons for being able to maintain a low discharge voltage will be described.

When the surface discharge gap dss between the first and second electrodes is large, the discharge firing voltage Vfss required to sustain a discharge between the first and second electrodes when the third electrode 22 is not utilized is greatly increased according to Paschen's Law.

Increases in the discharge firing voltage Vfss lead to corresponding increases in the external sustain voltage Vsus. Given that the sum total of wall charge on dielectric layer 13 over the first and second electrodes is Vwss, the voltage occurring in the discharge spaces equals the external sustain voltage Vsus+Vwss. Thus, to sustain the discharge between the first and second electrodes in the sustain period, formula 1, as given below, should be satisfied.

$$Vfss < Vsus + Vwss \qquad \text{Formula 1:}$$

As described above in relation to the discharge patterns of the present embodiment, a discharge is initiated between either the first and third electrodes (first vertical discharge space 30*a*) or the second and third electrodes (second vertical discharge space 30*b*) in order to sustain the discharge between the first and second electrodes. This allows the discharge firing voltage Vfss, and consequently the external sustain voltage Vsus, to be maintained at considerably low levels.

As described above in relation to the discharge patterns when the sustain pulse is applied, the first electrode 12*a* is negative when a discharge is to be initiated in the first vertical discharge space 30*a*, and the second electrode 12*b* is negative when the discharge is to be initiated in the second vertical discharge space 30*b*, which thus allows for further reductions in the discharge firing voltage. The reasons for this will be described after first defining a number of terms.

The discharge space between the first and third electrodes is defined as a first vertical discharge space 30*a*, and the discharge space between the second and third electrodes is defined as a second vertical discharge space 30*b*.

The discharge firing voltage applied between the first and second electrodes (i.e. within the gap dss) is given as Vfss.

The discharge firing voltage applied within in the first/second vertical discharge space when the first/second electrode has a low potential with respect to the third electrode 22 is given as Vfsa.

The discharge firing voltage applied within the first/second discharge space when the third electrode 22 has a low potential with respect to the first/second electrode is given a Vfas.

Thus Vfsa and Vfas are discharge firing voltages having opposite polarities. In comparison to Vfsa, which is the discharge voltage when protective layer 14, having a high secondary electron emission coefficient, is on the cathode side, Vfsa is the discharge firing voltage when phosphor layers 25, having a low secondary electron emission coefficient, are on the cathode side. Thus, Vfsa<<Vfas.

Having protective layer 14 on the cathode side is advantageous as it allows the discharge to be initiated at a lower discharge firing voltage.

The effects of the present invention will now be described with reference to the data in FIGS. 8 to 10.

Figure 8:
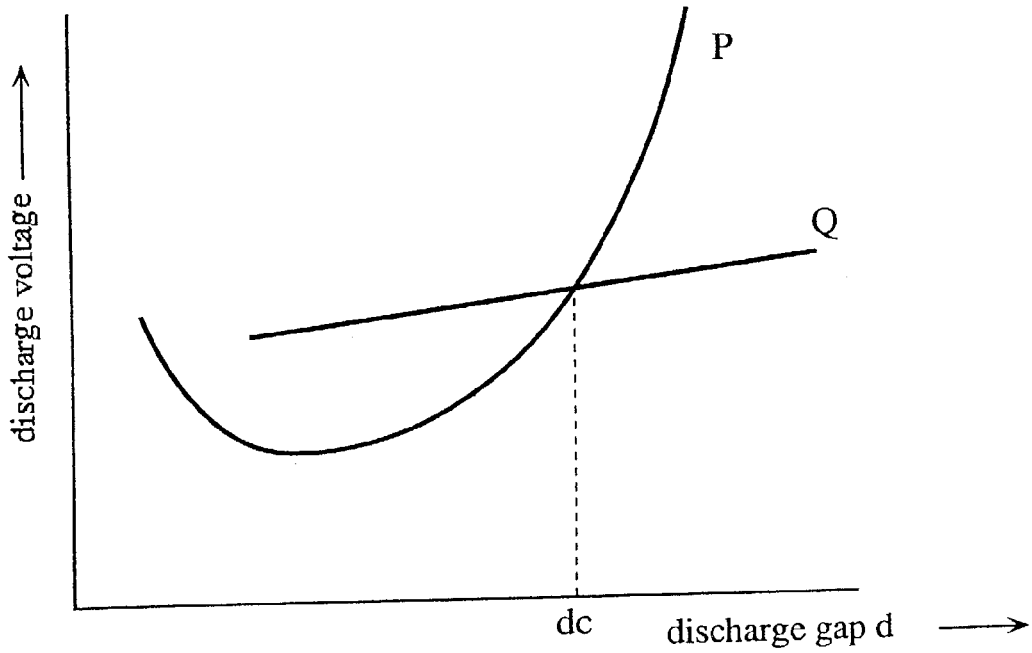
FIG. 8 is a characteristic diagram showing a relationship between a surface discharge gap and a discharge voltage.

FIG. 8 is a characteristic diagram showing the relationship between a discharge gap d (i.e. surface discharge gap) and the discharge voltage. The Q curve represents a discharge generated between the first and second electrodes when the third electrode 22 is utilized, as per the present embodiment. In contrast, the P curve represents a discharge generated between the first and second electrodes when the third electrode 22 is not included.

The P curve follows Paschen's Law. The discharge voltage has a minimum value at a relatively small discharge gap, and increases markedly with increases in the size of the discharge gap.

With respect to the Q curve, on the other hand, only slight increases in the discharge voltage result, even from substantial increases in the size of the discharge gap d. Thus the discharge voltage applied to the first and second electrodes can be maintained at levels substantially the same as the discharge voltage applied in the vertical discharge spaces. This is because the vertical discharge gap dsa remains fixed, and the discharge voltage is determined in relation to the fixed gap dsa.

Furthermore, according to FIG. 8, although the Q curve is higher than the P curve in regions where the discharge gap d is small, the Q curve is lower than the P curve beyond a certain gap length dc. In other words, the discharge voltage is lower when the discharge is conducted using both the third electrode 22 and phosphor layers 25. The gap length dc is referred to as the critical length.

The critical length is substantially the same as the vertical discharge gap dsa.

Consequently, when the surface discharge gap dss is larger than the vertical discharge gap dsa, the PDP can be driven at a discharge voltage that is lower than the discharge voltage estimated from the P curve.

This result proves that the PDP of the present embodiment can be driven at a discharge voltage substantially lower than the discharge voltage estimated for the discharge gap d according to Paschen's Law.

Figure 9:
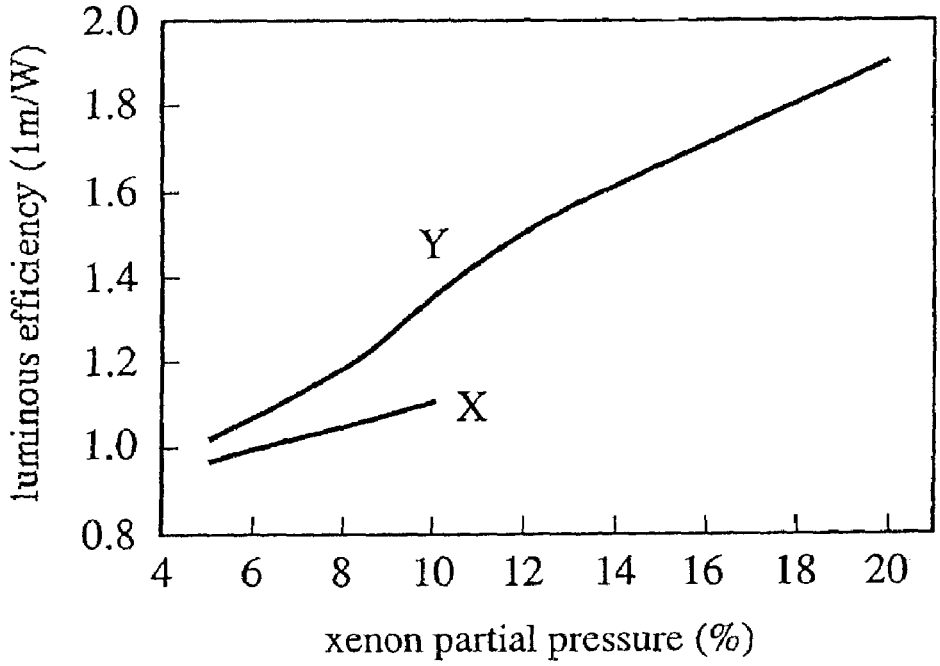
FIG. 9 shows a relationship between xenon partial pressure and luminous efficiency with respect to both the PDP of the present invention and a prior art PDP.

FIG. 9 shows changes in luminous efficiency relative to changes in xenon partial pressure, comparing the PDP of the present embodiment (i.e. discharge gap larger than height of discharge space) with the prior art PDP in FIGS. 11A and 11B (i.e. discharge gap smaller than height of discharge space). The results are based on a fixed discharge gas pressure of 67 kPa and a variable xenon partial pressure.

In FIG. 9, the X curve represents the prior art PDP, and the Y curve represents the PDP of the present embodiment. The xenon partial pressure is given as a percentage of the total discharge gas pressure, which is 67 kPa in the given example.

Although both curves show improvements in luminous efficiency as a result of increases in the xenon partial pressure, these improvements are substantially greater with respect to the Y curve.

This result proves clearly that enhancements in luminous efficiency gained through increases in the xenon partial pressure for a PDP having a discharge gap greater than the height of the discharge space are over and above similar improvements recorded in relation to the prior art PDP.

As shown in FIG. 9, particularly high luminous efficiency can be achieved when the xenon partial pressure is 10 vol % or greater (i.e. a xenon partial pressure of 6.7 kPa or greater).

Whereas known PDPs (i.e. Xe component approx. 5 vol %; discharge gap smaller than height of discharge space) can only achieve a luminous efficiency of approximately 1.01 m/W, FIG. 9 shows that in the PDP of the present embodiment, increases in the xenon partial pressure are matched by equal improvements in luminous efficiency. Thus it is clear that a PDP having enhanced luminous efficiency can be achieve by establishing both the discharge gap to be greater than the height of the discharge space, and the xenon partial pressure to be at least 2 kPa (e.g. a xenon component of at least 3.3 vol %, given a total discharge gas pressure of 66.7 kPa).

Furthermore, although the results in FIG. 9 were obtained by varying the xenon component at a fixed total discharge gas pressure, increasing the xenon partial pressure by varying the total pressure gives substantially the same improvements in luminous efficiency.

Figure 10:
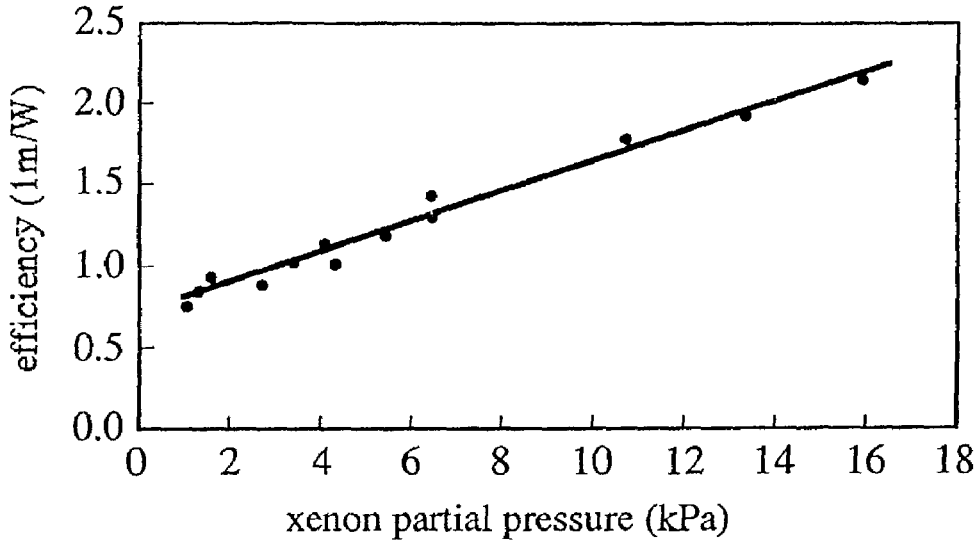
FIG. 10 shows a relationship between xenon partial pressure and luminous efficiency in the PDP of the present invention.

FIG. 10 shows the change in luminous efficiency when the xenon partial pressure is varied in a test PDP manufactured in accordance with the present embodiment. The relationship between xenon partial pressure (kPa) and luminous efficiency is shown.

Although the test PDP uses a gas mixture composed of neon and xenon, effects identical to those shown in FIG. 10 can be achieved by replacing the neon with helium, argon, krypton, or a mixture of these gases.

The maximum achievable xenon partial pressure depends on the breakdown voltage of the drive circuit.

With respect to the test PDP, a luminous efficiency of 2.1 lm/W was achieved, for example, when an external sustain voltage Vsus of 340V was applied. Although it is anticipated that even higher luminous efficiency can be achieved with further increases in the xenon partial pressure, limitations regarding the withstanding voltage of known circuitry dictates that the external sustain voltage not exceed 340V. Practical operation of the PDP at xenon partial pressures in excess of 16 kPa is presently not considered feasible.

In view of the above restrictions, the xenon partial pressure should preferably be maintained at 16 kPa or below.

If the breakdown voltage of the drive ICs can be increased, xenon partial pressures in excess of 16 kPa, say, 30 kPa, for example, may become achievable. Since the luminous efficiency as shown in FIG. 10 improves at an excellent rate with respect to increases in the xenon partial pressure, a high xenon partial pressure of 30 kPa would, according to the graph in FIG. 10, result in a luminous efficiency of around 3.5 lm/W.

Although practical operation of the PDP is not considered feasible at xenon levels in excess of 20 vol % when the total discharge gas pressure is around 66.7 kPa, the PDP can be driven at xenon levels in excess of 20 vol % by reducing the total pressure of the discharge gas.

As described above, by establishing the xenon partial pressure at 2 kPa or greater (or, alternatively, at 5 vol % of the total pressure), and by enlarging the gap between the first and second electrodes, it is possible to greatly enhance luminous efficiency while maintaining a low drive voltage in the AC PDP according to the present embodiment.

Furthermore, since it is readily feasible to achieve a surface discharge gap dss that is considerably larger than the vertical discharge gap dsa in high definition PDPs given the marked reductions in the gap dsa required in such PDPs, the PDP of the present embodiment is particularly suited to applications requiring high definition.

Variations

Although the above embodiment was described in relation to an AC PDP employing the address display period separated subfield (ADS) method, the same effects can be obtained in an AC PDP that uses other drive methods, an example of which is a method that involves the addressing being conducted sequentially line by line, and the discharge being sustained immediately after the addressing of each respective line.

Also, the waveform of voltages applied in the setup and address periods is not limited to those described in the above embodiment. For instance, the wall charge may be selectively formed in the discharge cells in accordance with the image data.

Furthermore, while the above embodiment was described in terms of band-like barrier ribs being formed parallel to the third electrodes, the same effects may be achieved, for example, by forming the barrier ribs in a grid.

INDUSTRIAL APPLICABILITY

The PDP drive method and display apparatus of the present invention are applicable in display apparatuses such as computers and televisions, and are particularly applicable in large-scale display apparatuses requiring both high definition and high brightness.

The invention claimed is:

1. A plasma display panel comprising:

a first substrate;

a second substrate arranged to face the first substrate;

barrier ribs located between the first substrate and the second substrate so as to define a discharge space between the barrier ribs;

a scan electrode and a sustain electrode arranged on a surface of the first substrate which faces the second substrate, the scan electrode and the sustain electrode being provided so as to extend parallel to each other;

a dielectric layer provided to cover the scan electrode and the sustain electrode;

an address electrode arranged on a surface of the second substrate which faces the first substrate, the address electrode being provided so as to extend orthogonally to the scan electrode and the sustain electrode; and a discharge gas provided within the discharge space;

wherein:

the discharge gas is a gas mixture containing xenon, the content of the xenon is 10 vol %–100 vol %; and a gap between the scan electrode and the sustain electrode is greater than a height of the discharge space.

2. A plasma display panel comprising:

a first substrate;

a second substrate arranged to face the first substrate;

barrier ribs located between the first substrate and the second substrate so as to define a discharge space between the barrier ribs;

a scan electrode and a sustain electrode arranged on a surface of the first substrate which faces the second substrate, the scan electrode and the sustain electrode being provided so as to extend parallel to each other;

a dielectric layer provided to cover the scan electrode and the sustain electrode;

an address electrode arranged on a surface of the second substrate which faces the first substrate, the address electrode being provided so as to extend orthogonally to the scan electrode and the sustain electrode; and a discharge gas provided within the discharge space;

wherein:

the discharge gas is a gas mixture containing xenon, the xenon having a partial pressure of at least 2 kPa; and a gap between the scan electrode and sustain electrode is greater than a height of the discharge space.

3. A plasma display panel comprising:

a first substrate;

a second substrate arranged to face the first substrate;

barrier ribs located between the first substrate and the second substrate so as to define a discharge space between the barrier ribs;

a scan electrode and a sustain electrode arranged on a surface of the first substrate which faces the second substrate, the scan electrode and the sustain electrode being provided so as to extend parallel to each other;

a dielectric layer provided to cover the scan electrode and the sustain electrode;

an address electrode arranged on a surface of the second substrate which faces the first substrate, the address electrode being provided so as to extend orthogonally to the scan electrode and the sustain electrode; and a discharge gas being provided within the discharge space;

wherein:

the discharge gas is a gas mixture containing xenon, a partial pressure of the xenon is 6.7 kPa–30 kPa; and a gap between the scan electrode and the sustain electrode is greater than a height of the discharge space.

4. A plasma display panel comprising:

a first substrate;

a second substrate arranged to face the first substrate;

barrier ribs located between the first substrate and the second substrate so as to define a discharge space between the barrier ribs;

a scan electrode and a sustain electrode arranged on a surface of the first substrate which faces the second substrate, the scan electrode and the sustain electrode being provided so as toextend parallel to each other;

a dielectric layer provided to cover the scan electrode and the sustain electrode;

an address electrode arranged on a surface of the second substrate which faces the first substrate, the address electrode being provided so as to. extend orthogonally to the scan electrode and the sustain electrode; and a discharge gas provided within the discharge space;

wherein:

the discharge gas is a gas mixture containing xenon, a partial pressure of the xenon is 10 kPa–30 kPa; and a gap between the scan electrode and sustain electrode is greater than a height of the discharge space.

5. A plasma display panel as in claim 1, wherein a discharge occurring in a discharge space between the sustain and address electrodes expands along the address electrode to a discharge space between the scan and address electrodes, and a discharge occurring in the discharge space between the scan and address electrodes expands along the address electrode to the discharge space between the sustain and address electrodes.

6. A plasma display panel as in claim 1, wherein a minimum voltage required to conduct a surface discharge between the scan and sustain electrodes when the address electrode is utilized is less than a minimum voltage required to conduct a surface discharge between the scan and sustain electrodes when the address electrode is not utilized.

7. A method for driving a plasma display panel as in claim 1, comprising:

writing an image by applying a writing pulse between the scan and address electrodes, and sustaining a discharge by alternately applying a first and second sustain pulse between the scan and sustain electrodes, the scan electrode being positive during the first sustain pulse and negative during the second sustain pulse with respect to the sustain electrode, wherein image display is achieved by repeating both the writing step and sustaining the discharge, and a timing of the first and second sustain pulses in sustaining the discharge is such that (i) subsequent to application of the first sustain pulse, a voltage is applied that initiates a discharge between the sustain and address electrodes, with the sustain electrode being negative, and (ii) subsequent to application of the second sustain pulse, a voltage is applied that initiates a discharge between the scan and address electrodes, with the scan electrode being negative.

8. The method according to claim 7, wherein a discharge sustain voltage applied between the scan and sustain electrodes by application of the first and second sustain pulses is less than a minimum voltage required to conduct a surface discharge between the scan and sustain electrodes when the address electrode is not utilized.

9. A plasma display panel apparatus comprising:

a plasma display panel as in claim 1; and a drive unit operable to drive the plasma display panel.

10. The display apparatus according to claim 9, wherein the drive unit includes a writing unit operable to write an image by applying a writing pulse between the scan and address electrodes; and discharge sustain unit operable to sustain a discharge by alternately applying a first and second sustain pulse between the scan and sustain electrodes, the scan electrode being positive during the first sustain pulse and negative during the second sustain pulse with respect to the sustain electrode, and the plasma display panel is structured such that (i) a discharge occurring in a discharge space between the sustain and address electrodes expands along the address electrode to a discharge space between the scan and address electrodes when the discharge sustain unit applies the first sustain pulse, and (ii) a discharge occurring in the discharge space between the scan and address electrodes expands along the address electrode to the discharge space between the sustain and address electrodes when the discharge sustain means applies the second sustain pulse.

11. The display apparatus according to claim 10, wherein a discharge sustain voltage applied between the scan and sustain electrodes by application of the first and second pulses is less than a minimum voltage required to conduct a surface discharge between the scan and sustain electrodes when the address electrode is not utilized.

12. A plasma display panel as in claim 2, wherein a discharge occurring in a discharge space between the sustain and address electrodes expands along the address electrode to a discharge space between the scan and address electrodes, and a discharge occurring in the discharge space between the scan and address electrodes expands along the address electrode to the discharge space between the sustain and address electrodes.

13. A plasma display panel as in claim 3, wherein a discharge occurring in a discharge space between the sustain and address electrodes expands along the address electrode to a discharge space between the scan and address electrodes, and a discharge occurring in the discharge space between the scan and address electrodes expands along the address electrode to the discharge space between the sustain and address electrodes.

14. A plasma display panel as in claim 4, wherein a discharge occurring in a discharge space between the sustain and address electrodes expands along the address electrode to a discharge space between the scan and address electrodes, and a discharge occurring in the discharge space between the scan and address electrodes expands along the address electrode to the discharge space between the sustain and address electrodes.

15. A plasma display panel as in claim 2, wherein a minimum voltage required to conduct a surface discharge between the scan and sustain electrodes when the address electrode is utilized is less than a minimum voltage required to conduct a surface discharge between the scan and sustain electrodes when the address electrode is not utilized.

16. A plasma display panel as in claim 3, wherein a minimum voltage required to conduct a surface discharge between the scan and sustain electrodes when the address electrode is utilized is less than a minimum voltage required. to conduct a surface discharge between the scan and sustain electrodes when the address electrode is not utilized.

17. A plasma display panel as in claim 4, wherein a minimum voltage required to conduct a surface discharge between the scan and sustain electrodes when the address electrode is utilized is less than a minimum voltage required to conduct a surface discharge between the scan and sustain electrodes when the address electrode is not utilized.

18. A method for driving a plasma display panel as in claim 2, comprising:

writing an image by applying a writing pulse between the scan and address electrodes, and sustaining a discharge by alternately applying a first and second sustain pulse between the scan and sustain electrodes, the scan electrode being positive during the first sustain pulse and negative during the second sustain pulse with respect to the sustain electrode, wherein image display is achieved by repeating both the writing step and sustaining the discharge, and a timing of the first and second sustain pulses in sustaining the discharge is such that (i) subsequent to application of the first sustain pulse, a voltage is applied that initiates a discharge between the sustain and address electrodes, with the sustain electrode being negative, and (ii) subsequent to application of the second sustain pulse, a voltage is applied that initiates a discharge between the scan address electrodes, with the scan electrode being negative.

19. A method for driving a plasma display panel as in claim 3, comprising:

writing an image by applying a writing pulse between the scan and address electrodes, and sustaining a discharge by alternately applying a first and second sustain pulse between the scan and sustain electrodes, the scan electrode being positive during the first sustain pulse and negative during the second sustain pulse with respect to the sustain electrode, wherein image display is achieved by repeating both the writing step and sustaining the discharge, and a timing of the first and second sustain pulses in sustaining the discharge is such that (i) subsequent to application of the first sustain pulse, a voltage is applied that initiates a discharge between the sustain and address electrodes, with the sustain electrode being negative, and (ii) subsequent to application of the second sustain pulse, a voltage is applied that initiates a discharge between the scan and address electrodes, with the scan electrode being negative.

20. A method for driving a plasma display panel as in claim 4, comprising:

writing an image by applying a writing pulse between the scan and address electrodes, and sustaining a discharge by alternately applying a first and second sustain pulse between the scan and sustain electrodes, the scan electrode being positive during the first sustain pulse and negative during the second sustain pulse with respect to the sustain electrode, wherein image display is achieved by repeating both the writing step and sustaining the discharge, and a timing of the first and second sustain pulses sustaining the discharge is such that (i) subsequent to application of the first sustain pulse, a voltage is applied that initiates a discharge between the sustain and address electrodes, with the sustain electrode being negative, and (ii) subsequent to application of the second sustain pulse, a voltage is applied that initiates a discharge between the scan and addresselectrodes, with the scan electrode being negative.

21. A plasma display panel apparatus comprising:

a plasma display panel as in claim 2; and a drive unit operable to drive the plasma display panel.

22. A plasma display panel apparatus comprising:

a plasma display panel as in claim 3; and a drive unit operable to drive the plasma display panel.

23. A plasma display panel apparatus comprising:

a plasma display panel as in claim 4; and a drive unit operable to drive the plasma display panel.

24. The plasma display panel according to claim 1, wherein:

$1.2 \times dsa \leqq dss \leqq 6 \times dsa$;

dsa=vertical discharge gap between the first and second substrates; and dss=surface discharge gap between the scan electrode and the sustain electrode.

25. The plasma display panel according to claim 2, wherein;

$1.233\ dsa \leqq dss \leqq 6 \times dsa$;

dsa=vertical discharge gap between the first and second substrates; and dss=surface discharge gap between the scan electrode and the sustain electrode.

26. The plasma display panel according to claim 3, wherein:

$1.2 \times dsa \leqq dss \leqq 6 \times dsa$;

dsa=vertical discharge gap between the first and second substrates; and dss=surface discharge gap between the scan electrode and sustain electrode.

27. The plasma display panel according to claim 4, wherein:

$1.2 \times dsa \leqq dss \leqq 6 \times dsa$;

dsa=vertical discharge gap between the first and second substrates; and dss=surface discharge gap between the scan electrode and the sustain electrode.

28. The plasma display panel according to claim 1, wherein a pulse voltage is applicable between the scan electrode and the sustain electrode to generate a discharge in the discharge space.

29. The plasma display panel according to claim 2, wherein a pulse voltage is applicable between the scan electrode and the sustain electrode to generate a discharge in the discharge space.

30. The plasma display panel according to claim 3, wherein a pulse voltage is applicable between the scan electrode and the sustain electrode to generate a discharge in the discharge space.

31. The plasma display panel according to claim 4, wherein a pulse voltage is applicable between the scan electrode and the sustain electrode to generate a discharge in the discharge space.

32. The plasma display panel according to claim 1, wherein the gas mixture contains neon.

33. The plasma display panel according to claim 2, wherein the gas mixture contains neon.

34. The plasma display panel according to claim 3, wherein the gas mixture contains neon.

35. The plasma display panel according to claim 4, wherein the gas mixture contains neon.

* * * * *

UNITED STATES PATENT AND TRADEMARK OFFICE

CERTIFICATE OF CORRECTION

PATENT NO. : 7,215,303 B2
APPLICATION NO. : 10/149300
DATED : May 8, 2007
INVENTOR(S) : Ando et al.

It is certified that error appears in the above-identified patent and that said Letters Patent is hereby corrected as shown below:

In the Claims:
Claim 4, Column 14, line 49, “toextend” should be two words --to extend--.
Claim 4, Column 14, line 54, the period in “to.” should be deleted.
Claim 16, Column 16, line 43, the period in “required.” should be deleted.
Claim 20, Column 17, line 49, “addresselectrodes” should be two words --address electrodes--.
Claim 25, Column 18, lien 13, “1.233” should read --1.2--.

Signed and Sealed this

Third Day of July, 2007

JON W. DUDAS
*Director of the United States Patent and Trademark Office*